United States Patent [19]

Nygren

[11] 4,213,613

[45] Jul. 22, 1980

[54] GOLF CLUB HEAD WITH CENTER OF GRAVITY NEAR ITS STRIKING FACE

[76] Inventor: Gordon W. Nygren, 321 Spring Valley Dr., Bloomington, Minn. 55420

[21] Appl. No.: 865,702

[22] Filed: Dec. 29, 1977

[51] Int. Cl.[2] ..... A63B 53/04

[52] U.S. Cl. ..... 273/169; 273/171; 273/173

[58] Field of Search ..... 273/77 R, 78, 167–175, 273/80.2, DIG. 8

[56] References Cited

U.S. PATENT DOCUMENTS

| | | | |
|---|---|---|---|
| 863,728 | 8/1907 | Legh | 273/169 |
| 922,444 | 5/1909 | Youds | 273/169 |
| 1,543,691 | 6/1925 | Beat | 273/173 X |
| 1,555,425 | 9/1925 | McKenzie | 273/169 |
| 1,567,248 | 12/1925 | Dahlman | 273/173 X |
| 1,678,637 | 7/1928 | Drevitson | 273/169 |
| 2,346,617 | 4/1944 | Schaffer | 273/169 X |
| 2,414,234 | 1/1947 | Link | 273/169 |
| 2,460,435 | 2/1949 | Schaffer | 273/169 |
| 3,212,783 | 10/1965 | Bradley et al. | 273/173 X |
| 3,644,168 | 2/1972 | Bonk et al. | 273/DIG. 8 |
| 3,847,399 | 11/1974 | Raymont | 273/78 X |
| 3,863,932 | 2/1975 | Lezatte | 273/173 X |

FOREIGN PATENT DOCUMENTS

| | | | |
|---|---|---|---|
| 16070 | of 1908 | United Kingdom | 273/169 |
| 408821 | 4/1934 | United Kingdom | 273/77 R |
| 459005 | 12/1936 | United Kingdom | 273/169 |
| 963652 | 7/1964 | United Kingdom | 273/173 |
| 1387955 | 3/1975 | United Kingdom | 273/171 |

OTHER PUBLICATIONS

"Golf Digest," Nov. 1975; p. 27.
"Golf World," Aug. 11, 1972, p. 22.

*Primary Examiner*—Richard J. Apley
*Attorney, Agent, or Firm*—Peterson, Palmatier, Sturm & Sjoquist, Ltd.

[57] ABSTRACT

The golf club head has a metal face plate, vertically spaced horizontal fins extending rearwardly from the back side thereof, and a central vertical rib between each pair of fins. Weight-carrying inserts are threadedly mounted in the face plate and also extend rearwardly from the back side of the face plate. Molded about the fins, ribs and inserts is a plastic material in the form of rigid or structural foamed polyurethane.

12 Claims, 7 Drawing Figures

GOLF CLUB HEAD WITH CENTER OF GRAVITY NEAR ITS STRIKING FACE

BACKGROUND OF THE INVENTION

1. Field of the Invention

This invention relates generally to golf clubs, and pertains more particularly to a golf club having a head with its center of gravity located just rearwardly of the face plate.

2. Description of the Prior Art

It has long been recognized that the weight distribution within a golf head can influence the competency of a golfer. Therefore, various efforts have been made throughout the years to permit a golfer to vary the amount of weight or mass contained in the golf head so as to best suit his particular game style.

U.S. Pat. No. 3,652,094 granted to Cecil C. Glover on Mar. 28, 1972 titled "Golf Club with Adjustable Weighting Plugs" treats the problem in a highly sophisticated manner, recognizing that the swing weight is a function of both the total weight of the head and the length of the moment arm from the club head portion's center of gravity to the fulcrum. Thus, it is brought out that any change in the weight of the club head or a change in the length of the moment arm will change the swing weight of the club.

However, the above-alluded to patent does not recognize that having the center of gravity quite close to the striking surface of the face plate will produce even a more superior performance. Also, the patent fails to take into account that the concentrated impact forces resulting from striking a golf ball should be distributed or dissipated throughout the material constituting the golf club head.

SUMMARY OF THE INVENTION

Therefore, an important object of the present invention is to shift the center of gravity as far forwardly or toward the striking surface of the head of the golf club as possible. More specifically, an aim of the invention is to locate the maximum mass behind the club face, actually concentrating almost all of the mass between the centerline of the shaft and the club face. Stated somewhat differently, it is within the purview of the invention to locate the center of gravity of the club head so that it will be for all intents and purposes on the same axis as the centerline of the club shaft. Since the shaft centerline is only slightly to the rear of the striking face, the force couple caused by the centrifugal force of the head with respect to the shaft is for all intents and purposes eliminated. This is in contradistinction to when the center of gravity is offset considerably or displaced appreciably from the shaft's centerline, for then the force couple, of course, becomes more pronounced, increasing with the amount of offset or displacement.

Another object of the invention is to obviate the side spin effect on the ball caused by the head rotating about the center of gravity of the club head due to an off center hit.

Another object of the invention is to enable the golfer to adjust the weight balance in a toe to heel direction for the best proper weight distribution for his particular style of swing.

Still another object of the invention is to achieve a maximum moment of inertia by distributing the mass with respect to the toe and heel of the club face.

Yet another object is to effect the maximum energy transfer from the club head to the ball by reason of a one-piece or unitary casting making up the club face.

Still further, an object of the invention is to provide a foam plastic that eliminates the problem of change in club head weight due to any accumulation of moisture.

A further object is to provide a foam that eliminates the shrink and loose head problem attributable to moisture loss.

A further object is to avoid having any inserts within the club head that are apt to become loss with a concomitant deleterious effect on the golfer's score.

Another object of the invention is to provide a golf head that will absorb vibrational forces within the head. Stated somewhat differently, an aim of the invention is to transmit rearwardly the forces resulting from the striking of a ball, doing so in such a manner that the vibrational forces are better distributed throughout the material that will absorb or dampen such forces very rapidly.

Quite briefly, my invention envisages an aluminum or magnesium face plate having integral fins extending rearwardly therefrom. The fins are generally horizontal and are spaced vertically with respect to each other, varying in their rearward length or distance from the face plate. More specifically, the middle fin extends the greatest distance rearwardly and the uppermost and lowermost fins a lesser distance. Between each pair of ribs is a centrally located vertical rib, each rib extending rearwardly the same distance as the fins it is intended to reinforce. Also, the face plate itself is thickest at the center thereof where the so-called "sweet spot" normally exists. In order to enable the golfer to vary the weight balance in a toe-to-heel direction, a pair of inserts are threadedly carried by the face plate and extend rearwardly therefrom, each having therein a preferred amount of high density metal, such as lead or a heavy tungsten alloy, so that the golfer can vary the weight by changing the amount of heavy metal in each insert.

Whereas the face plate and fins integral therewith are of aluminum or magnesium, the major portion of the head is of foamed polyurethane plastic. Such a plastic is of low density and coupled with the fact that the aluminum or magnesium face plate, fins and ribs are also of fairly low density, although not as low as foamed polyurethane, the lead or tungsten alloy contained in the two inserts constitutes the greatest amount of mass and is disposed forwardly so that the center of gravity is very near the striking face, actually for all intents and purposes along the centerline of the golf club's shaft. Also, the two inserts are spaced quite far from a vertical plane which is perpendicular to the striking surface of the face plate and which passes through the center of gravity, thereby providing a maximum moment of inertia. The ribs are located in this vertical plane.

DESCRIPTION OF THE PREFERRED EMBODIMENT

Figure 2:
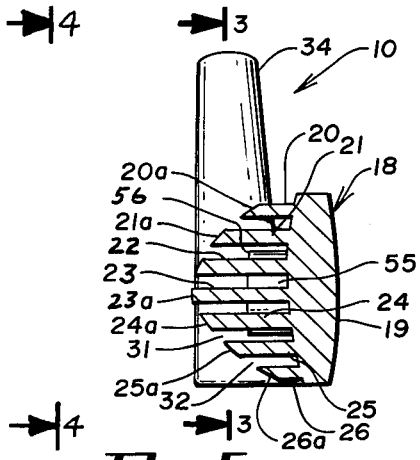
FIG. 2 is a sectional view taken in the direction of line 2—2 of FIG. 1 but without the foamed matrix included.

The golf club illustrating my invention has been indicated in its entirety by the reference numeral 10, and includes a head 12, a hosel 14, a shaft 16 and face plate 18 providing a striking surface 19. The face plate 18 is of aluminum or magnesium. As can best be understood from FIG. 2, the face plate 18 is thicker midway between its upper and lower edges.

Extending rearwardly from the back side of the face plate 18 are integral aluminum or magnesium fins 20, 21, 22, 23, 24, 25 and 26. More specifically, the uppermost fin has been labeled 20 and the lowermost fin 26. The rear edges of these fins 20–26 have been identified by means of the suffix "a." By designating the rear edges as 20*a*, 21*a*, 22*a*, 23*a*, 24*a*, 25*a* and 26*a*, it will be seen from FIGS. 2, 5 and 6 that the central or middle fin 23 has the greatest rearward length of all of the fins and the uppermost fin 20 and the lowermost fin 26 the shortest length. From FIG. 5, it will be discerned that these various fins curve horizontally so that they extend rearwardly an even lesser distance in the region of the club head's toe and heel.

Figure 1:
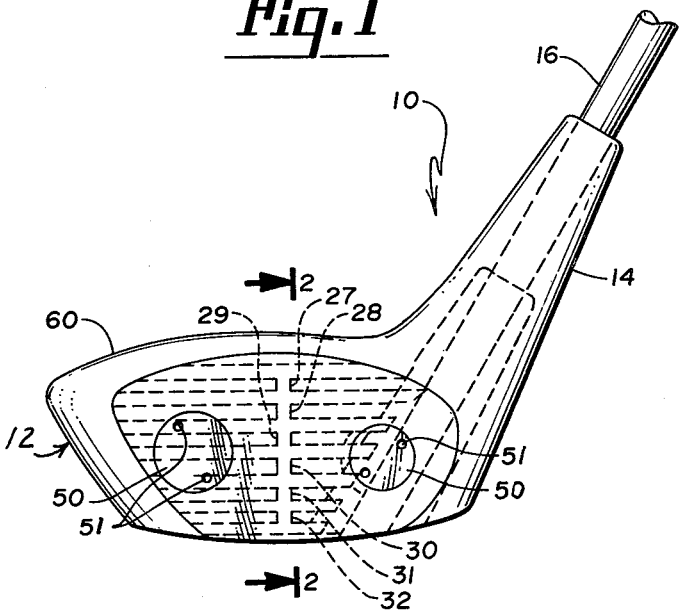
FIG. 1 is a front elevational view looking at the face plate of a golf club head exemplifying my invention.
Figure 5:
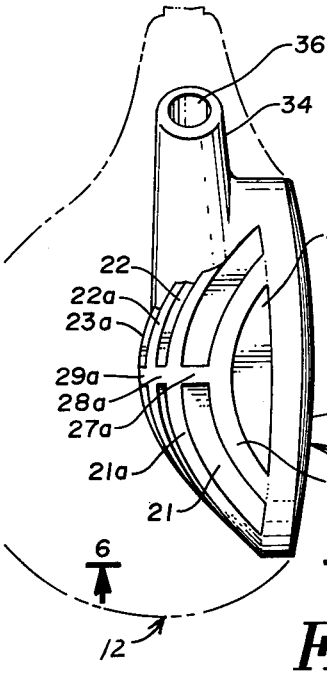
FIG. 5 is a top plan view corresponding to FIG. 4, the plastic matrix once again being shown only in phantom outline.
Figure 4:
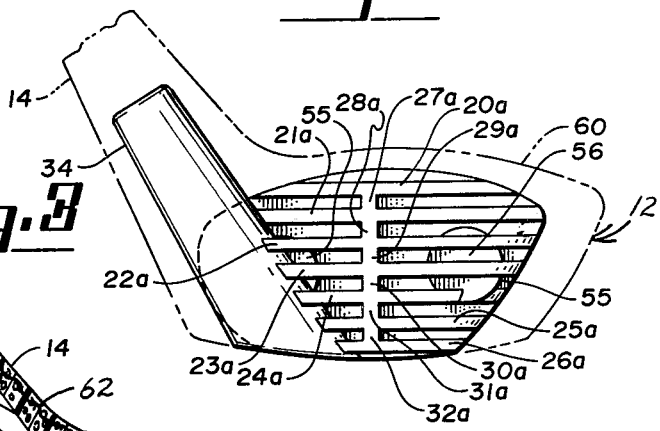
FIG. 4 is a view taken in the direction of line 4—4 of FIG. 2, that is from the rear, but with the foamed matrix shown only in phantom outline.
Figure 6:
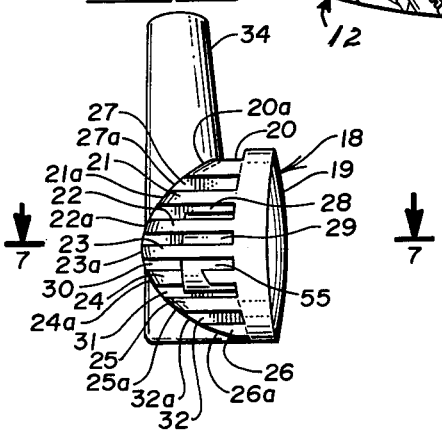
FIG. 6 is a view of the face plate and fins taken in the direction of line 6—6 of FIG. 5 but without the matrix included.

Between each pair of fins is a reinforcing vertical rib, the upper ribs being best seen in FIG. 5. All of the ribs, however, are visible in FIGS. 4 and 6 (and in phantom outline in FIG. 1). Progressing downwardly from the top, it will be perceived that the ribs have been identified by the reference numerals 27, 28, 30, 31 and 32. Their rear edges have been given the numerals 27*a*, 28*a*, 29*a*, 30*a*, 31*a* and 32*a*, respectively. The rib 27, which is intermediate the fins 20 and 21, extends rearwardly from the back side of the face plate 18 the same distance as the fins 20 and 21. In other words, the upper portion of the edge 27*a* is even with the lower portion of the edge 20*a*, and the lower portion of the edge 27*a* is even with the upper portion of the edge 21*a*. In like manner the edge 28*a* is coterminous with the edges 21*a* and 22*a*. The same holds true for the edges 29*a* (relative the edges 21*a*, 22*a*), 30*a* (relative the edges 22*a*, 23*a*), 31*a* (relative the edges 23*a*, 24*a*), and 32*a* (relative the edges 24*a*, 25*a*). In this way, the ribs 27–32 are integrally connected to the fins 21–26, thereby reinforcing the fins in a vertical direction. Due to the fact that both the fins 21–26 and the ribs 27–32 are quite thin, these components add far less mass behind the face plate 18 than if solid.

Figure 3:
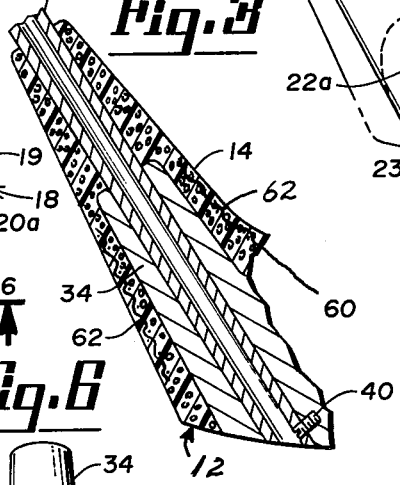
FIG. 3 is a fragmentary sectional view of the rear portion of the head, the view being taken in the direction of line 3—3 of FIG. 2.

Since it is planned that the face plate 18 and the various fins 20–26 and the ribs 27–32 be cast, a tubular boss 34 can be formed during the casting procedure. The boss 34 is then drilled so as to provide a bore 36 (although the bore appears eliptical in FIG. 7 owing to the inclined axis of the boss 34). The bore 36 is reamed with a tapered reamer so as to impart a slight taper thereto. Thus, the lower end of the shaft 16, which is also tapered, can be received in the bore 36 and held through the agency of a set screw 40 (FIG. 3).

Figure 7:
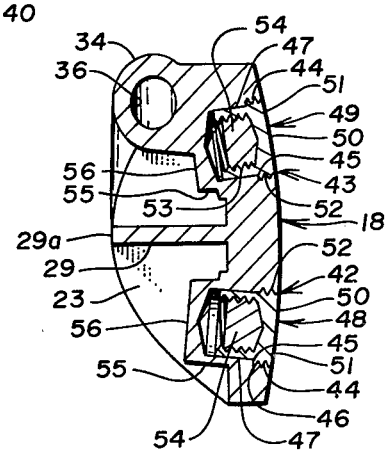
FIG. 7 is a sectional view taken in the direction of line 7—7 of FIG. 6.

As can be understood from FIG. 7, the face plate 18 contains therein a pair of counterbored holes at 42 and 43. Each hole 42, 43 has a threaded portion 44, an intermediate shoulder 45 and an unthreaded portion 47. In this way, a pair of cup-shaped inserts 48 and 49 can be mounted in the holes 42 and 43, respectively. Each insert 48 and 49 has a closed end 50 containing therein a pair of spanner wrench holes 51, a threaded flange 52 and an internally threaded recess 53. It will be recognized that the threaded flange 52 is received in the threaded portion 44 and sufficient tightening of the two inserts 48 and 49 will cause their respective flanges 52 to bear against the shoulder 45. When this is achieved, then the closed end 50 is flush with the front or striking surface of the face plate 18. Either or both of the recesses 53 of the inserts 48 and 49 contains a quantity of heavy metal 54, such as lead or a predetermined number of tungsten alloy slugs. The amount of heavy metal 54 will enable the golfer to vary the toe and heel weight balance for the proper weight distribution best suited for his style of golf.

To prevent the foamed plastic referred to below from entering the rear of the holes 42 and 43 during the molding operation, the rear ends of the holes 42, 43 are suitably plugged. As can be discerned in FIG. 7 the back side of the face plate 18 is formed with rearwardly projecting integral sleeves 55 having closed ends 56. Care must be exercised in drilling the holes 42 and 43 not to drill completely through; otherwise, the aluminum or magnesium, as the case may be, forming the closed ends 56 would be removed by the drill and would allow foamed plastic, while still molten, to fill or partially fill, the holes 42, 43.

In order to impart the requisite aerodynamic characteristics to the club head 12, the face plate 18 and its seven fins 20–26 have molded thereabout a matrix 60 of rigid foamed plastic, polyurethane having been found to be particularly suitable since it has a density less than the aluminum or magnesium used for the face plate 18, the various fins 20–26 and the ribs 27–32. Actually, foamed polyurethane has only 1/10th the weight of aluminum and 1/6th the weight of magnesium. The rigid foamed plastic 60 extends rearwardly from the upper edge, the lower edge and the toe and heel edges of the face plate 18 and completely encases the fins 20–26, as is believed from FIGS. 1, 4 and 5.

In order to impart additional strength to the club head 12 where the hosel 14 merges into what has been referred to as the matrix portion of the head 12, a section of fiberglass mat 62 is placed in the mold when forming the head 12, this mat appearing in section in FIG. 3.

Recapitulating, it will be appreciated, particularly from FIG. 2, owing to the low density of the polyurethane matrix 60, that most of the mass is near the back side of the face plate 18. While the foamed polyurethane matrix 60 constitutes the greatest volume of the head 12, it is quite lightweight, as has already been explained. Without the heavy metal 54 (lead or tungsten alloy), the center of gravity, as viewed in FIG. 2, would be somewhat to the left or rearwardly of the plane in which the sectional view along the line 3—3 is taken which plane contains the centerline of the shaft 16. However, the introduction of the high density metal 54 by means of the inserts 48 and 49 will move the center of gravity to the right or toward the face plate 18. Not only does the heavy metal 54 bring the center of gravity substantially along the axis of the shaft 16, but the capability of having more weight in either the insert 48 or 49 will enable the golfer to vary the balance in a toe-to-heel direction.

In other words, the golfer can readily effect a shifting of the center of gravity from front to rear or from toe to heel so as to best suit his particular game. It should be recognized that the appreciable spacing of the inserts 48 and 49 from each other, and more importantly from a plane (which contains the ribs 27–32) perpendicular to the striking surface 19 of the face plate 18 which plane passes through the head's center of gravity, provides a maximum moment of inertia. This broadens or widens the effective striking area, commonly known as the "sweet spot."

I claim:

1. A golf club comprising a shaft, a metal face plate, the center line of said shaft residing in a first vertical plane disposed rearwardly from said face plate and generally parallel to said face plate, metal means extending rearwardly from the back side of said face plate and terminating at a location adjacent said vertical plane, the mass of said rearwardly extending metal means decreasing in opposite lateral directions from a centrally disposed vertical plane passing through said first plane and said face plate and also decreasing toward said face plate so that the center of gravity of said metal means resides between said first vertical plane and said face plate, the mass of said rearwardly extending metal means also decreasing in a vertical direction above and below a centrally disposed horizontal plane passing through said face plate so that the center of gravity of said metal means also resides generally in said horizontal plane, and relatively low density foamed plastic material encasing said rearwardly extending metal means to form an aerodynamically curved outer surface, said foamed plastic material having a center of gravity so that the overall center of gravity of said head resides substantially in said first vertical plane.

2. A golf club head comprising a metal face plate, a plurality of vertically spaced metal fins extending rearwardly from the back side of said face plate, the rear edges of said fins being horizontally curved and the uppermost and lowermost of said fins extending rearwardly a lesser distance than those fins in between, and relatively low density material encasing said fins to form an aerodynamically curved outer surface.

3. The golf club of claim 2 including a vertical rib extending rearwardly from the back side of said face plate between adjacent fins.

4. The golf club of claim 3 in which said in between fins include a central fin, a first pair of spaced fins between said uppermost fin and said central fin, and a second pair of spaced fins between said lowermost fin and said central fin.

5. The golf club of claim 4 in which said first and second pair of fins extend rearwardly a lesser distance than said central fin but rearwardly a greater distance than said uppermost and lowermost fins.

6. The golf club of claim 5 in which the fins of said first and second pairs which are nearer said central fin extend rearwardly a greater distance than do the remaining fins of said first and second pairs which are nearer said uppermost and lowermost fins.

7. The golf club head of claim 6 in which said face plate is thicker intermediate its upper and lower edges than at said upper and lower edges.

8. A golf club head comprising a metal face plate, a plurality of vertically spaced metal fins extending rearwardly from the back side of said face plate, relatively low density material encasing said fins to form an aerodynamically curved outer surface, two cup-shaped inserts each having an open end and a closed end, said face plate being formed with two counterbored holes therein, one of said holes being to one side of a centrally disposed vertical plane and the other to the other side of said plane, the counterbores of said holes being internally threaded and each insert having an externally threaded flange corresponding in thickness to the depth of the counterbore in which it is received so that the closed end of each insert is flush with the striking surface of said face plate, said threaded counterbores and said threaded flanges threadedly mounting said inserts in said face plate, weight means in at least one of said inserts, and a vertical rib disposed between each pair of fins, said ribs residing generally in said vertical plane.

9. The golf club of claim 8 in which the rear edges of said fins are horizontally curved.

10. The golf club head of claim 8 in which the uppermost and lower most fins extend rearwardly a lesser distance than those fins in between.

11. The golf club head of claim 10 in which the rear edges of said ribs are coterminous with the rear edges of said fins.

12. A golf club head comprising a metal face plate, metal means extending rearwardly from the back side of said face plate, the mass of said rearwardly extending metal means decreasing in opposite lateral directions from a centrally disposed vertical plane passing through said face plate and said mass of said rearwardly extending metal means also decreasing in a vertical direction above and below a centrally disposed horizontal plane passing through said face plate, said rearwardly extending metal means including a plurality of vertically and equally spaced metal fins extending rearwardly from the back side of said face plate, those fins nearer said centrally disposed horizontal plane extending farther rearwardly than those fins spaced farther above said centrally disposed horizontal plane.

* * * * *

UNITED STATES PATENT OFFICE

CERTIFICATE OF CORRECTION

Patent No. 4,213,613 Dated July 22, 1980

Inventor(s) Gordon W. Nygren

It is certified that error appears in the above-identified patent and that said Letters Patent are hereby corrected as shown below:

Column 2, line 11, change "loss" to --loose--.

Signed and Sealed this

Eleventh Day of November 1980

[SEAL]

Attest:

SIDNEY A. DIAMOND

Attesting Officer

Commissioner of Patents and Trademark